US010828885B2

(12) United States Patent
Cronin

(10) Patent No.: US 10,828,885 B2
(45) Date of Patent: Nov. 10, 2020

(54) ROUNDED IMAGE CANVAS CORNERS

(71) Applicant: Entrust Corporation, Shakopee, MN (US)

(72) Inventor: Patrick C. Cronin, Shakopee, MN (US)

(73) Assignee: Entrust Corporation, Shakopee, MN (US)

( * ) Notice: Subject to any disclaimer, the term of this patent is extended or adjusted under 35 U.S.C. 154(b) by 108 days.

(21) Appl. No.: 16/013,209

(22) Filed: Jun. 20, 2018

(65) Prior Publication Data

US 2018/0370220 A1 Dec. 27, 2018

Related U.S. Application Data

(60) Provisional application No. 62/522,929, filed on Jun. 21, 2017.

(51) Int. Cl.

| | |
|---|---|
| ***B41F 16/00*** | (2006.01) |
| ***B41M 7/00*** | (2006.01) |
| *B41M 3/14* | (2006.01) |

(52) U.S. Cl.

CPC ..... *B41F 16/00* (2013.01); *B41F 16/0046* (2013.01); *B41M 7/0027* (2013.01); *B41M 3/14* (2013.01); *B41M 2205/10* (2013.01)

(58) Field of Classification Search

CPC ..... B41F 16/00; B41F 16/046; B41M 3/14; B41M 7/0027; B41M 2205/10

See application file for complete search history.

(56) References Cited

U.S. PATENT DOCUMENTS

| | | | | |
|---|---|---|---|---|
| 5,786,836 | A | 7/1998 | Glennon, Jr. | |
| 6,039,480 | A | 3/2000 | Andoh et al. | |
| 6,543,685 | B1 * | 4/2003 | Lien | G06K 1/121 101/4 |
| 6,894,710 | B2 | 5/2005 | Suzuki et al. | |
| 7,119,283 | B1 * | 10/2006 | Varkey | H01B 7/2806 174/102 R |
| 7,870,824 | B2 * | 1/2011 | Helma | B32B 37/185 101/33 |
| 9,676,179 | B2 * | 6/2017 | Maynard | B32B 37/226 |
| 2002/0190429 | A1 | 12/2002 | Bolken | |

(Continued)

FOREIGN PATENT DOCUMENTS

JP 2005343023 A 12/2005

OTHER PUBLICATIONS

International Search Report and Written Opinion issued in PCT/US2018/038477 dated Nov. 8, 2018; 13 pages.

*Primary Examiner* — Matthew G Marini
*Assistant Examiner* — Marissa Ferguson-Samreth
(74) *Attorney, Agent, or Firm* — Hamre, Schumann, Mueller & Larson, P.C.

(57) ABSTRACT

A printing process that reduces the amount of flash that occurs when printing to a surface of a plastic card. The printing can occur by a retransfer printing process. The printing process includes generating an image canvas that has rounded corners instead of the conventional right angle corners. The use of rounded corners on the image canvas reduces the amount of printing in the image canvas at the corners compared to an image canvas that has right angle corners, thereby reducing the amount of printing that is present that could form flash at the corners of the card surface.

10 Claims, 6 Drawing Sheets

(56) References Cited

U.S. PATENT DOCUMENTS

| | | | | |
|---|---|---|---|---|
| 2003/0000637 | A1* | 1/2003 | Campion | B32B 37/182 156/264 |
| 2003/0117481 | A1 | 6/2003 | Komentani et al. | |
| 2004/0004658 | A1 | 1/2004 | Tytgat | |
| 2012/0257918 | A1* | 10/2012 | Perry | B41J 15/042 400/590 |
| 2015/0306897 | A1* | 10/2015 | Lamb | B42D 25/23 156/222 |
| 2016/0101608 | A1* | 4/2016 | Woizeschke | B41M 3/12 156/234 |
| 2018/0333963 | A1* | 11/2018 | Cronin | B41J 2/325 |

* cited by examiner

ROUNDED IMAGE CANVAS CORNERS

FIELD

This description relates to printing images onto surfaces of plastic cards such as financial (e.g., credit, debit, or the like) cards, driver's licenses, national identification cards, business identification cards, gift cards, and other plastic cards which bear personalized data unique to the cardholder and/or which bear other card information.

BACKGROUND

Flash, or flashing, refers to excess material that remains at one or more edges of a plastic card as a result of printing an image on the card surface. One example of where flash may occur is in retransfer printing. Retransfer printing is a known printing process where an image is printed by a printing mechanism onto an intermediate retransfer material. After the image is printed, the intermediate retransfer material is transferred by lamination onto the surface of the plastic card that is to bear the printed image. FIG. 1 illustrates an example of a portion of a plastic card personalization machine 10 that is configured to perform retransfer printing. The machine 10 includes a printing section 12 that prints onto a retransfer material 14 via a print ribbon 16 and a print head 18. After printing is complete, the retransfer material 14 bearing the printing is transported to a transfer station 20 where a portion of the retransfer material 14 bearing the printing is transferred onto a surface of a plastic card 22. Suitable controls known in the art are provided to align the printing to be transferred with the plastic card 22. Further information on retransfer printing can be found in, for example, U.S. Pat. No. 6,894,710 which is incorporated herein by reference in its entirety.

FIG. 2 illustrates an example of a conventional retransfer printing process. An intermediate retransfer material 30 is illustrated onto which an image canvas 32 has been printed in the printing section 12 of FIG. 1. The image canvas 32 is typically rectangular in shape with substantially right angle corners 34. The image canvas 32 is a term that refers to the entire area of printing that occurs on the retransfer material 30. Within the image canvas 32 an area 36 is depicted in the shape of an outline 38 of the perimeter edge of the card surface which forms the area of the image canvas 32 that is intended to be transferred onto the card surface (in actual practice, the outline 38 does not actually appear on the retransfer material 30). Surrounding the outline 38 is a margin or buffer zone 40 of printing that is provided to allow some tolerance in the printing process and so that if there are slight inaccuracies in aligning the card surface with the area 36 at the transfer station 20, some of the printing in the margin 40 will transfer to the card surface.

SUMMARY

A printing process is described that reduces the amount of flash that occurs when printing to a surface of a plastic card. The printing can occur by a retransfer printing process.

The printing process includes generating an image canvas that has rounded corners instead of the conventional right angle corners. The use of rounded corners on the image canvas reduces the amount of printing in the image canvas at the corners compared to an image canvas that has right angle corners, thereby reducing the amount of printing that is present that could form flash at the corners of the card surface.

The techniques described herein can be applied to retransfer printing where an image is printed by a printing mechanism onto an intermediate retransfer material and thereafter the intermediate retransfer material containing the image is transferred by lamination onto the surface of the plastic card that is to bear the printed image.

DRAWINGS

FIG. 4 is a perspective view of a card substrate that is to be printed on.

DETAILED DESCRIPTION

Figure 3:
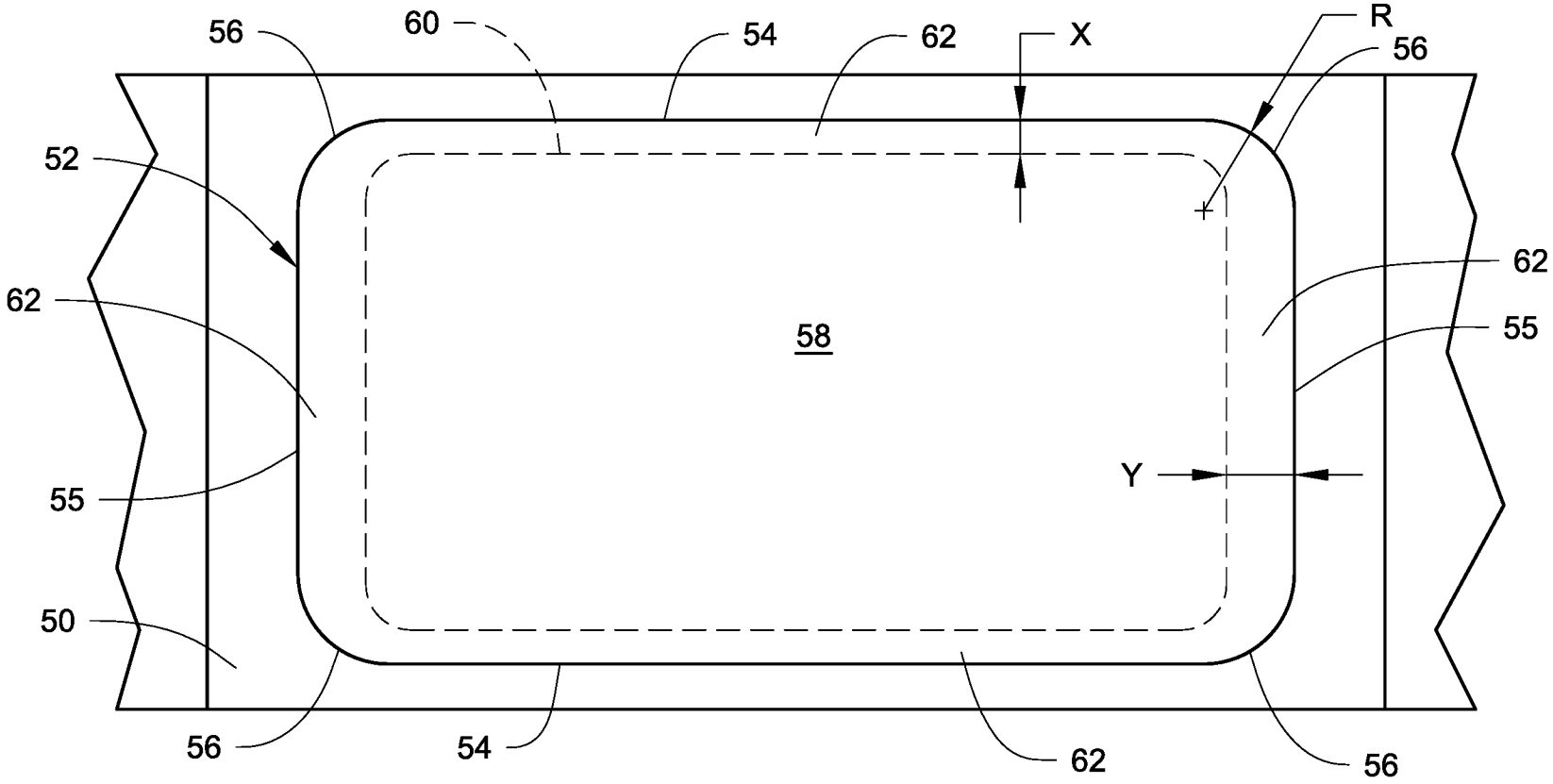
FIG. 3 illustrates an example of an image canvas used in the printing process described herein.

Referring to FIG. 3, a portion of an intermediate retransfer material 50 is illustrated. The retransfer material 50 can be any conventional retransfer material known in the art. In general, the retransfer material 50 includes a carrier layer (not specifically shown) and a transferable printing receptive layer (not specifically shown) that can be printed on. The transferable printing receptive layer is carried by the carrier layer, and is transferable from the carrier layer onto a card surface in a manner well understood in retransfer printing. U.S. Pat. No. 6,894,710, which is incorporated herein by reference in its entirety, is one example of retransfer printing. The retransfer material 50 is supplied from a supply roll 17 (see FIG. 1) and after transfer of the transferable printing receptive layer bearing the printed image at the transfer station 20 (FIG. 1) the remaining retransfer material 50 is wound onto a take-up roll 19 (see FIG. 1).

Figure 1:
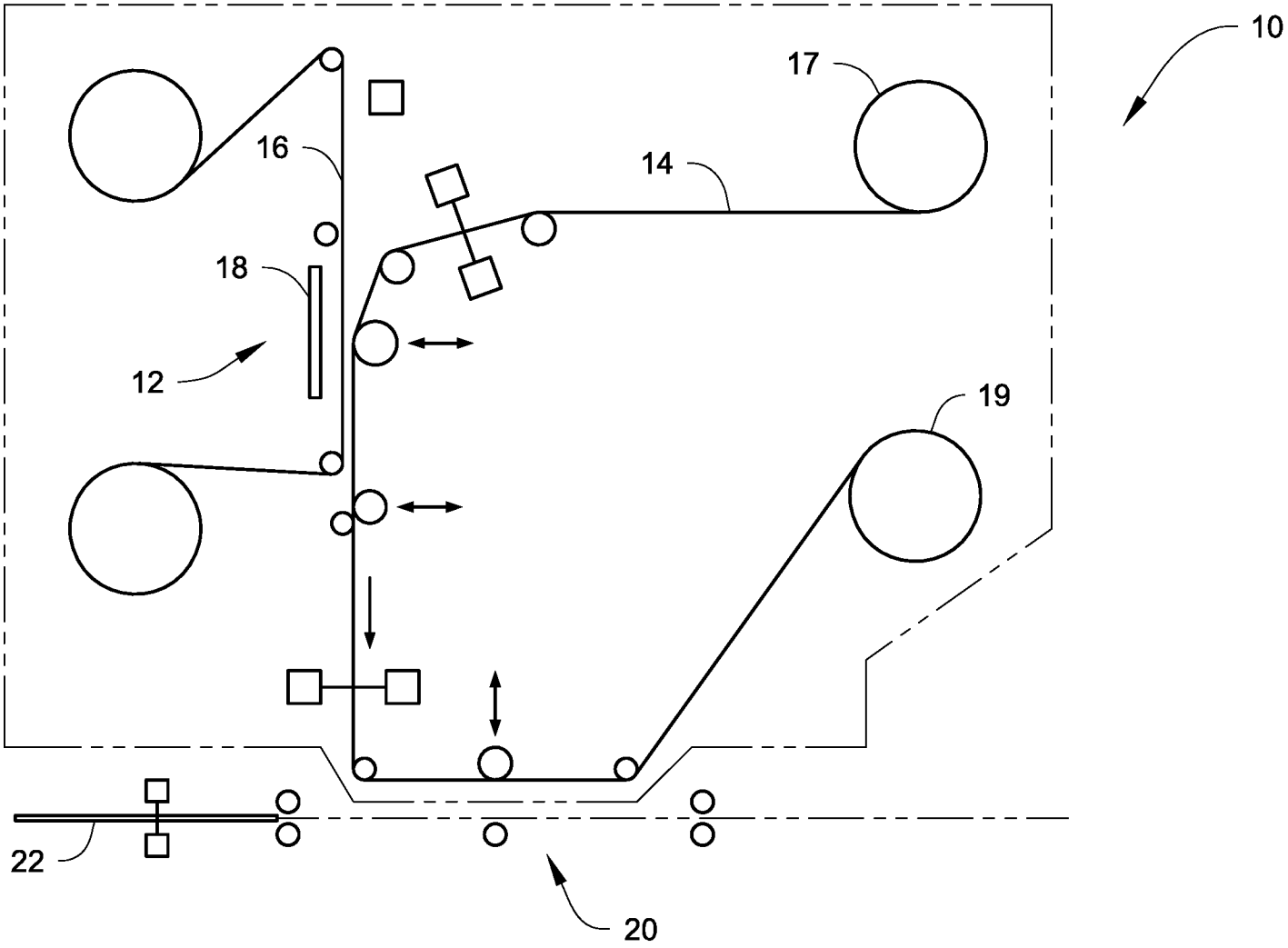
Fig. 1 Prior Art
FIG. 1 illustrates an example of a portion of a conventional plastic card personalization machine that is configured to perform retransfer printing.
Figure 2:
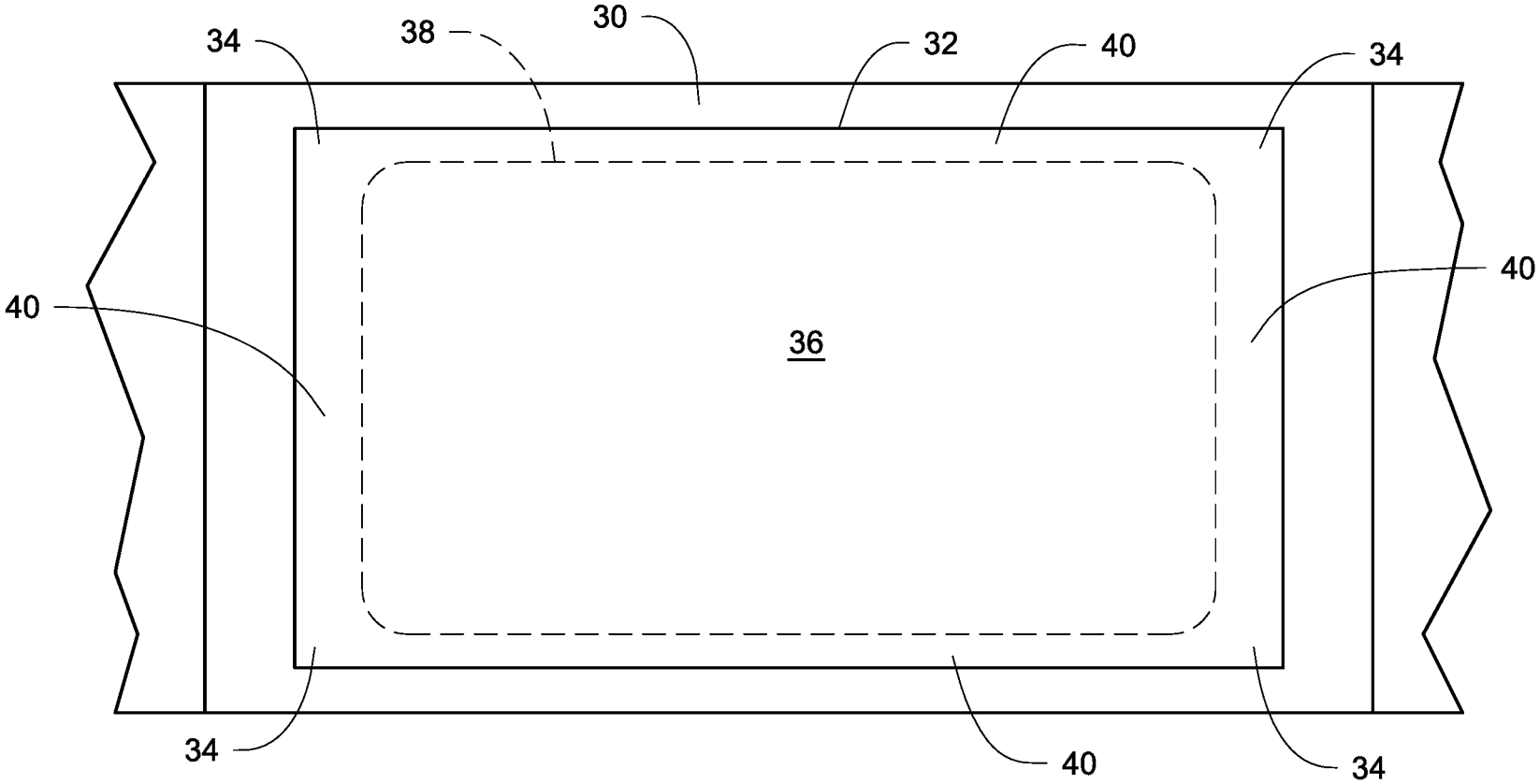
Fig. 2 Prior Art
FIG. 2 illustrates an example of an image canvas used in a conventional retransfer printing process.
Figure 4:
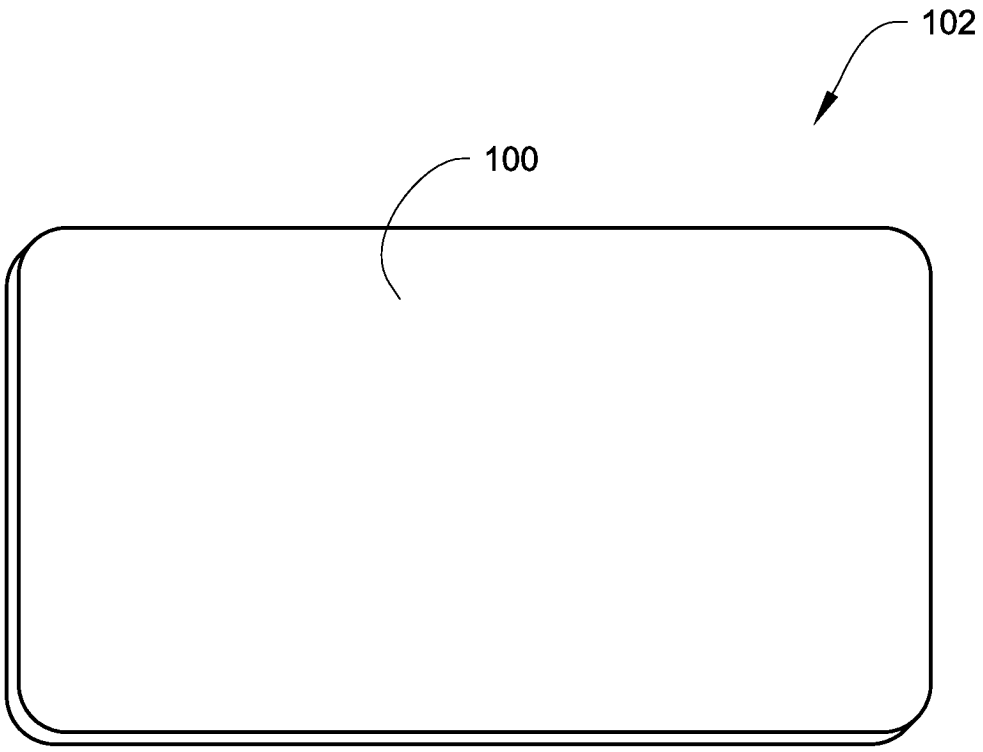

FIG. 3 shows an image canvas 52 that has been printed onto the printing receptive layer of the retransfer material 50, for example using the printing section 12 of FIG. 1. The image canvas 52 can be printed using a pigment, a dye or a primer. Primer is an additional adhesive to provide a better bond and is applied before the dye or pigment printing. For example, the transferable printing receptive layer can be difficult to adhere to some cards (e.g., ABS and polycarbonate), and thus a primer may be used to create a better bond between the card and the transferable printing receptive layer. The image canvas 52 has the shape of a rounded rectangle with linear sides 54, linear ends 55, and rounded corners 56. The image canvas 52 has a shape that mimics, and a size that is larger than the size of, a card surface 100 of a card 102 (see FIG. 4) to which printing on the transferable printing receptive layer of the retransfer material 50 is to be transferred.

FIG. 3 illustrates an area 58 in the shape of an outline 60 of the perimeter edge of the card surface 100. The area 58 bounded by the outline 60 forms the area of the image canvas 52 that is intended to be transferred onto the card surface 100 (the outline 60 is illustrated in FIG. 3 to delineate the area of the transferable printing receptive layer material that is to be transferred onto the card surface 100 but in actual practice the outline 60 does not actually appear on the retransfer material 50). Surrounding the outline 60 is a margin or buffer zone 62 of printing that is provided to allow some tolerance in the printing process and so that if there are slight inaccuracies in aligning the card surface 100 with the area 58 at the transfer station 20 (see FIG. 1), some of the printing in the margin 62 will transfer to the card surface 100.

The distance X between the linear sides 54 of the image canvas 52 and the corresponding linear sides of the outline 60 can be, for example, about 0.8 to about 1.0 mm. In addition, the distance Y between the linear ends 55 of the image canvas 52 and the corresponding linear ends of the outline 60 can be, for example, about 0.8 to about 1.0 mm. The radius R of the rounded corners 56 can be, for example, about 0.125 inches (i.e. 3.175 mm).

The card 102 can be a plastic card such as a financial (e.g., credit, debit, or the like) card, driver's license, national identification card, business identification card, gift card, and other plastic cards which bear personalized data unique to the cardholder and/or which bear other card information. As used herein, the term data is intended to encompass text and graphics such as images. In one embodiment, in addition to the printing described herein, the financial card can include a magnetic stripe that can be magnetically encoded with data, an integrated circuit chip that can be programmed with data, or both a magnetic stripe and an integrated circuit chip. In one embodiment, at least some data on the magnetic stripe and/or the integrated circuit chip can match data that is printed on the financial card. For example, the intended card holder's name and/or the account number can be printed on the financial card as well as stored on the magnetic stripe and/or on the integrated circuit chip. Encoding data on the magnetic stripe (if present) and programming data on the integrated circuit chip (if present) can occur prior to or after the printing on the card 102, within the same card personalization machine.

The printing in the area 58 of the image canvas 52 that is transferred to the card surface 100 can include, for example, alphanumeric text or characters, images, or combinations thereof. The printing can include variable data (e.g. data that is variable from one card to the next) that is personal to an intended holder of the card. Examples of variable data include, but are not limited to, a home address, a name, a portrait image (e.g., a photograph), and other identifying information. Variable data can similarly be referred to as personalization information. The variable data can be personal to an individual for whom the card is printed, randomly generated, related to the card issuer, or the like. The printing can also include fixed or non-variable data that may appear on multiple cards and is not personal to the intended holder of the card. Examples of non-variable data include, but are not limited to, a background image or graphics of the card surface, a government entity name, a name of the document issuer, a company logo, a general security logo, or the like.

The printing described herein can occur in any card personalization machine. The card personalization machine can be a desktop card personalization machine that is designed to personalize cards one at a time, for example on the order of tens or hundreds per hour, or a central issuance system that is designed to simultaneously personalize multiple cards, for example on the order of thousands per hour.

Figure 6:
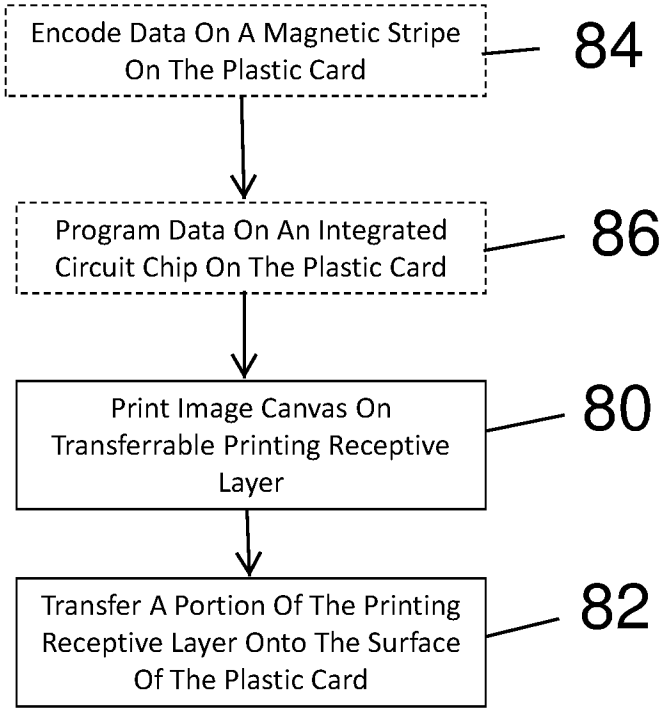
FIG. 6 is a flow chart of a process described herein.

In operation, and referring to FIGS. 1, 3 and 6, when the surface 100 of the card 102 is to be printed on, the data sufficient to form the image canvas 52 is generated and the image canvas 52 is printed in step 80 onto the transferable printing receptive layer of the retransfer material 50 at the printing section 12. Thereafter, the retransfer material 50 bearing the printed image canvas 52 is advanced to the transfer station 20. In addition, the card 102 is transported into the transfer station 20 with the surface 100 facing toward the transfer material 50. The card 102 and the retransfer material 50 are aligned with one another, for example using conventional alignment techniques, so that the area 58 of the image canvas 52 is aligned with the surface 100. Heat and pressure are then applied to the retransfer material 50 to transfer and laminate the transferable printing receptive layer bearing the printed area 58 to the surface 100 in step 82. In addition, data can be encoded on the magnetic stripe (if present) in step 84, and data can be programmed on the integrated circuit chip (if present) in step 86.

Figure 5:
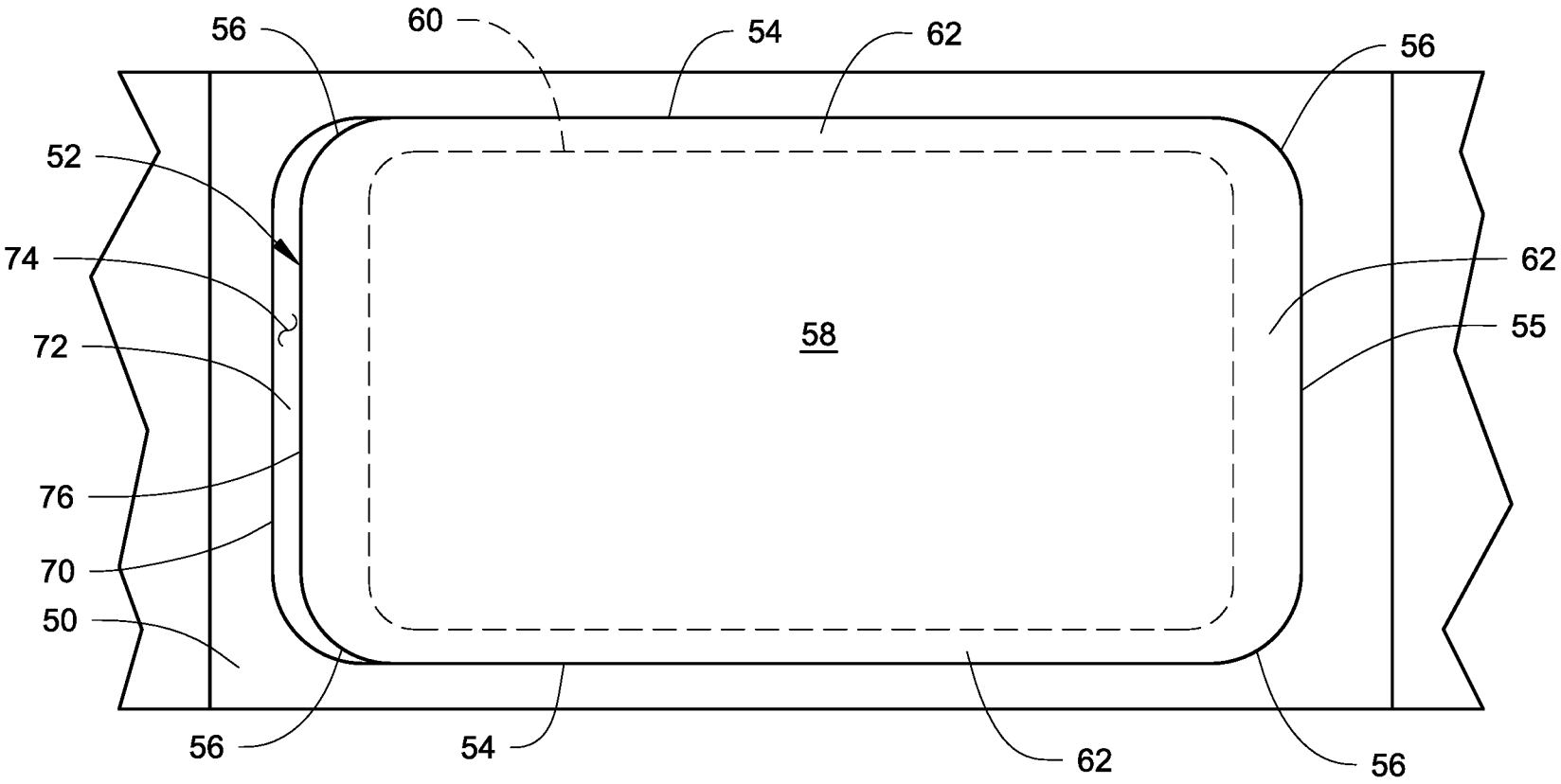
FIG. 5 illustrates an embodiment where a primer layer is applied before the start of the color printing forming the image canvas.

Referring to FIG. 5, in some embodiments, when a primer is used, the primer can be printed/applied starting about 0.5 to about 1.5 mm in advance of the dye or pigment printing. In another embodiment, the primer can be applied/printed starting about 0.5 mm to about 1.0 mm in advance of the dye or pigment printing. Thus, as seen in FIG. 5, a leading edge 70 of the image canvas 52 may include a primer layer 72 that is put down (i.e. starts) in advance of the pigment or dye printing 76 so that there is a buffer area 74 of about 0.5 to about 1.5 mm, or about 0.5 to about 1.0 mm, of primer before the start of the pigment or dye printing 76 on the image canvas 52.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of printing an image on a surface of a plastic card, comprising:

printing an image canvas on a transferable printing receptive layer carried by a carrier layer, the printed image canvas including the image that is to be printed on the surface of the plastic card, the printed image canvas has an area that is larger than the surface of the plastic card, and the printed image canvas having a shape of a rounded rectangle with rounded corners; and transferring a portion of the transferable printing receptive layer containing a portion of the printed image canvas from the carrier layer onto the surface of the plastic card;

wherein the printed image canvas reduces an amount of printing that is present that could form flash at corners of the surface of the plastic card upon transferring the portion of the transferable printing receptive layer from the carrier layer onto the surface of the plastic card.

2. The method of claim 1, wherein the printing comprises dye or pigment printing.

3. The method of claim 2, wherein printing the image canvas includes printing a primer on the transferable printing receptive layer, the printing of the primer begins at a location upstream of where the dye or pigment printing starts so that there is a buffer area of the primer before the start of the dye or pigment printing.

4. The method of claim 1, wherein an area surrounding and bordering the printed image canvas comprises the transferable printing receptive layer.

5. The method of claim 1, wherein the plastic card comprises a financial card having at least one of a magnetic stripe and an integrated circuit chip.

6. The method of claim 5, further comprising data on the magnetic stripe and/or on the integrated circuit chip, and at least some of the data matches printed data on the printed image canvas.

7. The method of claim 5, wherein the financial card includes the magnetic stripe, and the method further comprises encoding data on the magnetic stripe.

8. The method of claim 7, wherein the encoding data on the magnetic stripe occurs prior to printing the image on the surface of the plastic card.

9. The method of claim 5, wherein the financial card includes the integrated circuit chip, and the method further comprises programming data on the integrated circuit chip.

10. The method of claim 9, wherein the programming data on the integrated circuit chip occurs prior to printing the image on the surface of the plastic card.

* * * * *